United States Patent [19]

Newsteder

[11] 4,041,971

[45] Aug. 16, 1977

[54] SIPHON STARTING DEVICE

[76] Inventor: Robert Newsteder, South Orange, N.J.

[21] Appl. No.: 640,404

[22] Filed: Dec. 15, 1975

[51] Int. Cl.[2] ..... F04F 10/00

[52] U.S. Cl. ..... 137/148; 137/151

[58] Field of Search ..... 137/142, 147, 148, 150, 137/151, 153

[56] References Cited

U.S. PATENT DOCUMENTS

| | | | |
|---|---|---|---|
| 108,087 | 10/1870 | Higgins et al. | 137/148 |
| 351,088 | 10/1886 | Bean | 137/148 X |
| 443,496 | 12/1890 | Bowser et al. | 137/148 |
| 503,232 | 8/1893 | Franklin | 137/148 X |
| 550,932 | 12/1895 | Maschmeyer | 137/148 |
| 568,018 | 9/1896 | Daniels | 137/148 |
| 1,462,082 | 7/1923 | Carr | 137/151 X |
| 2,830,608 | 4/1958 | Miller | 137/148 |
| 3,670,758 | 6/1972 | Willinger | 137/150 |
| 3,682,193 | 8/1972 | Newsteder | 137/151 |

FOREIGN PATENT DOCUMENTS

| | | | |
|---|---|---|---|
| 271,751 | 6/1927 | United Kingdom | 137/148 |

*Primary Examiner*—Alan Cohan
*Assistant Examiner*—Gerald A. Michalsky
*Attorney, Agent, or Firm*—Edward R. Weingram

[57] ABSTRACT

A siphon includes an inverted U-shaped tube providing a passage between a main and an auxiliary container of water. A longer leg of the tube is connected to the upper end of a first section of an enclosed chamber which extends deeply into the main container. The chamber is partitioned into two adjacent longitudinal sections by a common wall having an opening at the lower end. The bottom of the second section is spaced above the base of the first section. The second section includes a flat plunger having a long movable vertical rod which extends out of the top. Water enters through inlets in the bottom of the first section and top of the second section until the chamber is full. A pivotable flapper valve controls the opening in the wall between the two sections. The rod and plunger are raised to the upper position and rapidly moved down to the edge of the bottom opening. This causes the valve to pivot away from the opening while blocking the inlet holes in the first section. Water from the second section is thus forced up into the first section and through the tube to fill the passage to the other container and start the siphoning section. The volume of water in the second section is preferably greater than that of the inverted tube in order to start siphoning in only one stroke of the plunger.

11 Claims, 5 Drawing Figures

SIPHON STARTING DEVICE

BACKGROUND OF THE INVENTION

1. Field of the Invention

The present invention relates to siphoning devices and particularly to a device for starting a siphon in a simplified manner upon the downward stroke of a plunger.

2. Description of the Prior Art

Presently available siphon starting devices are somewhat complex and require an awkward lifting motion of a rod and disc having an opening and valve forming part of the disc. Such devices are shown in U.S. Pat. No. 1,349,683, issued Aug. 17, 1920, and U.S. Pat. No. 3,682,193 of the present inventor, issued Aug. 8, 1972. The latter device is particularly useful in filtering water in home aquariums. The lifting operation is slow and inefficient and often requires several strokes to start the siphoning action.

SUMMARY OF THE INVENTION

It is therefore the primary object of the present invention to provide a simplified more efficient siphon starting device.

A further object is to provide an improved starting device for a siphon useful in home aquariums, and which can operate rapidly on a downward stroke of a plunger.

This is accomplished with a unique enclosed chamber submersed in a main water tank such as used for a home aquarium. The chamber is connected to an inverted U-shaped tube providing a passageway extending over the edge to another adjacent auxiliary container which may be used for filtering the water in the main tank. The chamber is partitioned into first and second longitudinal sections by a common dividing wall having an opening at the lower end. The opening and bottom of the second section are spaced above the base of the first section. A pivotable flapper valve controls the passage of water through the opening between the two sections. The first section connects to the U-shaped tube at the upper end and has inlets at the bottom to permit entry of water. The second section has inlet openings on the top and a flat plunger connected to a long vertical rod extending from the upper edge of the wall opening through the top of the chamber above the tank. The rod and plunger are raised to an upper level and then rapidly moved down to the lower opening. This forces water through the opening, causing the valve to pivot away and block the inlet holes in the first section while permitting entry of water from the second section into the first. Water is thus forced up through the U-shaped tube, filling the passageway to the auxiliary container and starting the siphoning action. This will start in one stroke, if the volume of water in the second section is greater than that of the tube. Other objects and advantages will become apparent from the following description taken in conjunction with the accompanying drawings.

DESCRIPTION OF THE PREFERRED EMBODIMENT

Figure 1:
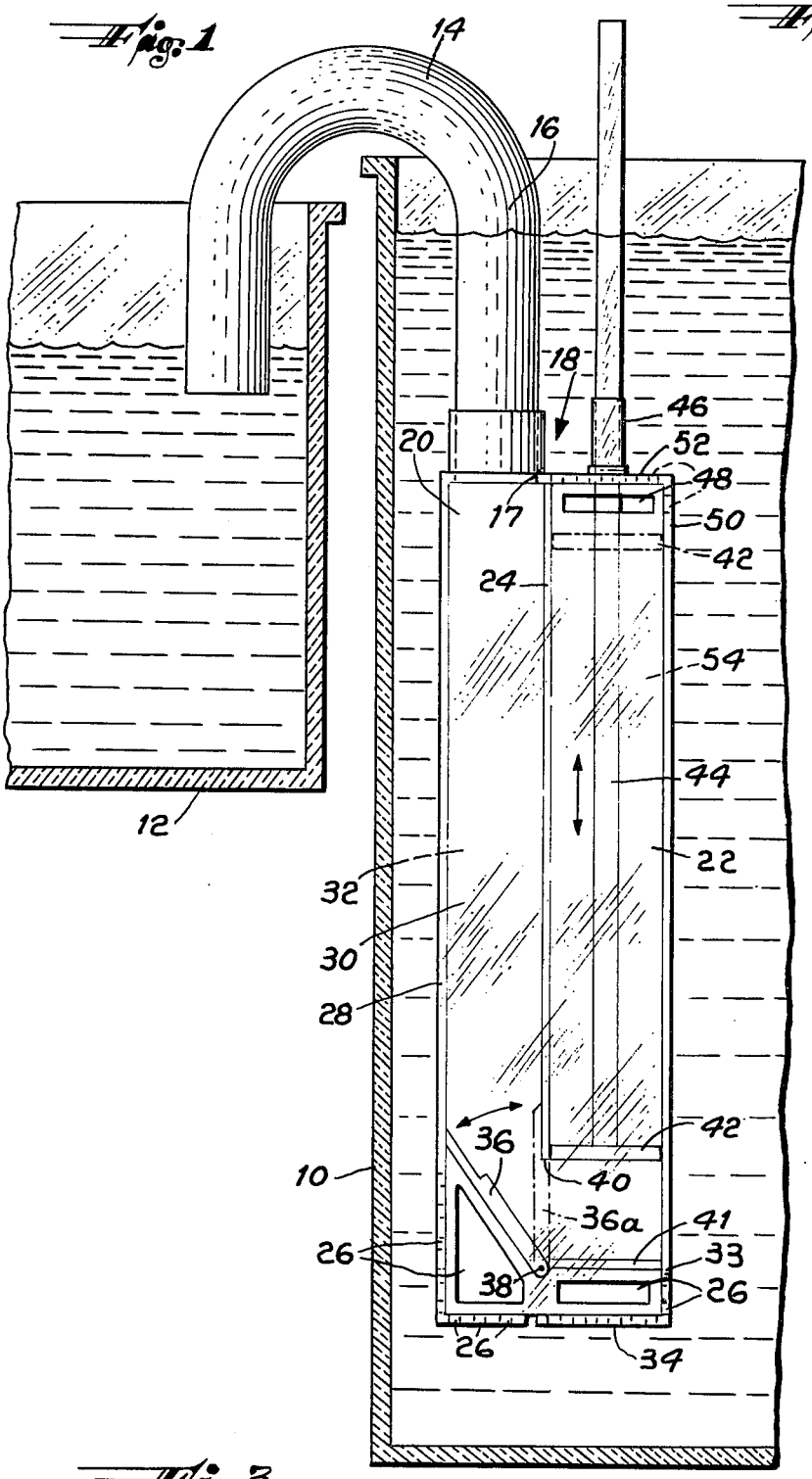
FIG.1 is a front view showing the siphoning device in a main water tank adjacent an auxiliary tank.

In order to filter water from home aquariums or fish tanks 10, such as shown in FIG. 1, it is usually necessary to siphon out the water into an adjacent auxiliary tank 12 which has filtration equipment. After filtering, the water is returned to the main tank. The processing may take place on a steady continuing basis without depleting the entire water supply from the main tank or disturbing the fish. The siphoning action occurs as long as the water level in the main tank is higher than the level in the auxiliary tank. To start the siphon, it is necessary for water to fill the inverted U-shaped hollow siphon tube 14. Otherwise the presence of air in the passageway prevents water from flowing out of tank 10 over the bend in the tube into the lower water level in tank 12.

Figure 2:
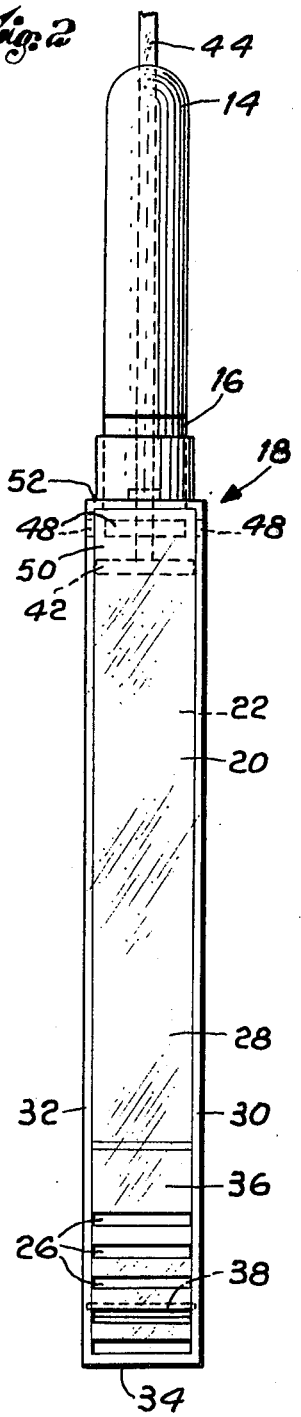
FIG. 2 is a side view of the siphoning device.
Figure 4:
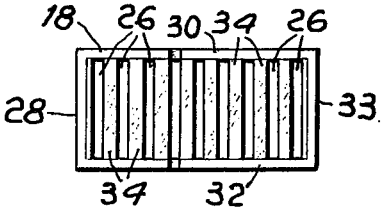
FIG. 4 is a lateral cross-section of the siphon chamber.

The end of the longer leg 16 of tube 14 is removably coupled in a tight sliding fit with an open neck 17 in the top of a rectangular chamber 18 extending longitudinally toward the bottom of the tank which is filled with water. Chamber 18 is partitioned into two adjoining sections 20, 22 separated by a common vertical wall 24. The upper end of the first section 20 iS connected to tube 14 and the lower end has a plurality of water inlet openings 26, as shown in FIGS. 1, 2 and 4, in the outer side and bottom walls 28, 30, 32, 33, 34. The openings are preferably sufficiently narrow so that small fish or debris cannot enter the siphon. A flapper valve 36 is pivotally mounted on a shaft 38 secured between walls 30, 32 at the bottom of an opening 40 at the lower end of wall 24. A horizontal platform 41 forms the bottom of section 22 which is spaced above the bottom wall 34 of section 20 and the main chamber. Platform 41 provides a watertight separation between the two sections and shaft 38 of valve 36 is secured directly below the edge of the platform in a close fit. Opening 40 communicates with the second section 22 and valve 36 controls the passage of water through the opening between the two sections. Valve 36 is shown in the open position, while dot-dashed lines **36*a* indicate the closed position of the valve. Inlet holes 26 in walls 28, 30, 32, 33 and 34 are located only in the area below valve 36 and platform 41** as will be further explained.

Figure 3:
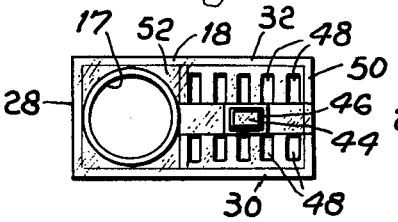
FIG. 3 is a top view of the siphon chamber with the inverted tube removed.

As shown in FIGS. 1, 2 and 3, section 22 includes a flat rectangular plunger 42 connected at the lower end of a movable rectangular vertical rod 44 which extends through an opening in the upper end of section 22 and out of the tank 10 above the water. A collar 46 is secured tightly around rod 44 above the chamber to provide a stop for limiting downward movement of the rod. The collar prevents plunger 42 from moving past the upper edge of opening 40. Holes 48 in the upper outside and top walls 30, 32, 50, 52 of section 22 provide inlets for water.

In operation, when the chamber is immersed in the tank, water first enters holes 26 at the bottom of section 20 and then through holes 48 at the top of section 22. Valve 36 first closes but fits loosely in section 20, so that the water from the lower end fills up section 20 and also passes slowly through opening 40 into the lower end of section 22 and around loose fitting plunger 42. The upper end of section 22 then fills up through the holes 48 so that the water pressure is equalized throughout the chamber and valve 36 opens. This and the loose fit of plunger 42 in section 22 permit relatively free vertical movement of the rod by hand.

Figure 5:
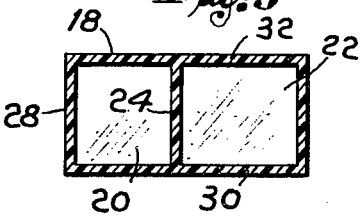
FIG. 5 is a bottom view of the chamber.

The rod and plunger are first raised slowly to the upper position indicated by dot and dashed lines in FIG. 1 and dashed lines in FIG. 2, at which time valve 36 moves into the closed position 36*a*. The rod and plunger are then moved down rapidly to the upper edge of opening 40. This provides a hydraulic piston action which opens valve 36 and forces water from section 22 through opening 40 into section 20 and up through the tube 14 into the auxiliary tank 12. One such downward stroke is generally sufficient to fill the tube 14 with water to start the siphoning action. In order to insure this one stroke operation, the dimensions of section 22 are designed so that the volume of water in section 22 between the top of opening 40 and the raised plunger 42 is greater than that of the U-shaped tube 14. Sufficient water is then supplied during one downward stroke of plunger 42 to fill tube 14 and start the siphoning action. As shown in FIG. 5, the cross-sectional area of section 22 is made larger than that of section 20 in order to achieve this desired volume.

The open position of valve 36 blocks holes 26 in the lower portion of section 20 so that the force of the water from section 22 is not dissipated or provided with another path through the holes, but is directed upwardly through section 20. In addition, the collar 46 on rod 44 limits the downward movement so that plunger 42 does not move beyond the upper edge of opening 40. This likewise prevents bypassing of the force applied by the plunger so that a strong pumping action is obtained. Due to the operation of valve 36, the pumping does not interfere with the siphoning action. All of the various elements of the tube and chamber are preferably of a suitable clear thermoplastic material to permit visual observance of the siphon device in an aquarium. The shaft 38 of valve 36, however, may be made of a suitable corrosion resistant metal.

While only a single embodiment has been illustrated and described, it is apparent that many variations may be made in the particular design and configuration without departing from the scope of the invention as set forth in the appended claims.

What is claimed is:

1. A siphon device comprising:

an enclosed longitudinal chamber having outer walls and an intermediate longitudinal wall dividing said chamber into first and second separate adjacent longitudinal sections, and a passageway at the lower end of said intermediate wall between said sections;

means providing an outlet for liquid at the upper end of said first section;

a valve pivotally secured across an end of said passageway to open and close said passageway, said valve contacting said intermediate wall in the closed position to block said passageway between said sections;

means for admitting said liquid into said first and second sections including an opening in the lower end of said first section; and a movable longitudinal rod extending through the upper end of said chamber into said second section and having a lateral plunger at the lower end of said rod adapted to direct liquid from said second section into said first section through said passageway and open said valve upon downward movement of said rod and plunger, said valve contacting an outer wall of said first section in the open position to block said opening in said lower end of said first section.

2. The device of claim 1 wherein said first and second sections are within a common enclosure and have a common intermediate wall, said valve being secured at the lower end of said passageway.

3. The device of claim 2 wherein said means providing an outlet includes an opening in said upper end of said first section, and an inverted U-shaped hollow tube having one end adapted for connection to said upper opening and the other end adapted to direct said liquid outwardly.

4. The device of claim 3 wherein said upper end of said first section includes an open neck portion, said one end of said tube being removably engageable with said neck portion.

5. The device of claim 3 wherein said means for admitting said liquid includes a plurality of inlet openings in the lower end of said outer walls of said first section and in the upper end of said outer walls of said second section.

6. The device of claim 5 wherein said inlet openings in the lower end of said first section are disposed below the open position of said valve, said valve blocking said lower end of said first section in said open position and adapted to direct liquid upwardly into said first section.

7. The device of claim 6 including means for limiting the downward movement of said rod so that said plunger does not extend below the upper end of said passageway.

8. The device of claim 7 including a lateral platform closing the lower end of said second section adjacent said lower end of said passageway and said valve, said platform being spaced above the bottom wall of said first section and chamber.

9. The device of claim 8 wherein the volume of said second section between the upper end of said second section and the upper end of said passageway is greater than the volume of said hollow tube.

10. The device of claim 8 wherein said means for limiting movement of said rod is a ridge around a portion of said rod extending out of said chamber.

11. The device of claim 8 wherein said valve is pivotally mounted on a shaft extending laterally between opposite outer side walls of said chamber.

* * * * *